US006140976A

United States Patent [19]

Locke et al.

[11] Patent Number: 6,140,976

[45] Date of Patent: Oct. 31, 2000

[54] METHOD AND APPARATUS FOR MITIGATING ARRAY ANTENNA PERFORMANCE DEGRADATION CAUSED BY ELEMENT FAILURE

[75] Inventors: John W. Locke, Mesa; William J. Haber, Tempe, both of Ariz.; Paul A. Chiavacci, Hopkington, Mass.

[73] Assignee: Motorola, Inc., Schaumburg, Ill.

[21] Appl. No.: 09/390,987

[22] Filed: Sep. 7, 1999

[51] Int. Cl.[7] ..... H01Q 21/00

[52] U.S. Cl. ..... 343/853; 342/374; 342/173

[58] Field of Search ..... 343/853, 893, 343/876; 342/372, 374, 368, 173, 174

[56] References Cited

U.S. PATENT DOCUMENTS

| | | | |
|---|---|---|---|
| 4,359,740 | 11/1982 | Frazita | 343/703 |
| 4,811,032 | 3/1989 | Boksberger et al. | 343/876 |
| 5,027,127 | 6/1991 | Shnitkin et al. | 342/372 |
| 5,083,131 | 1/1992 | Julian | 342/372 |
| 5,122,806 | 6/1992 | Julian | 342/173 |
| 5,412,414 | 5/1995 | Ast et al. | 342/174 |
| 5,929,809 | 7/1999 | Erlick et al. | 342/372 |

OTHER PUBLICATIONS

Beng–Kiong Yeo and Yilong Lu, "*Array Failure Correction with Genetic Algorithm*", IEEE Transactions on Antennas Propagation, P. 823–828, vol. 47, No. 5, May 1999.

*Primary Examiner*—Don Wong
*Assistant Examiner*—Ephrem Alemu
*Attorney, Agent, or Firm*—Frank J. Bogacz

[57] ABSTRACT

An array antenna (10) having a plurality of antenna elements (12) keeps only a subset of elements active during normal antenna operation. When a failure of one of the active elements in the array (10) is detected, one of the previously inactive elements (46) is activated to operate as a replacement for the failed element (50). The number of elements that are active during normal operation is selected to achieve a level of antenna performance required by an underlying antenna application. Thus, a desired level of antenna performance is maintained during the life of the array antenna (10) without the consumption of excess power by spare elements in the antenna. Redistributions of inactive element locations are periodically performed during the life of the array antenna (10) to enhance antenna performance in light of failed element locations.

20 Claims, 3 Drawing Sheets

METHOD AND APPARATUS FOR MITIGATING ARRAY ANTENNA PERFORMANCE DEGRADATION CAUSED BY ELEMENT FAILURE

FIELD OF THE INVENTION

The invention relates generally to array antenna systems and, more particularly, to methods for dealing with antenna element failures within array antenna systems.

BACKGROUND OF THE INVENTION

An array antenna is a structure that utilizes a number of individual antenna elements held in fixed relation to one another to collectively generate one or more antenna beams. A phased array antenna is an array antenna that is able to steer a generated beam by varying an excitation phase associated with each of the antenna elements. A number of different factors dictate the overall antenna pattern that is generated by an array antenna. These factors include: the number of elements in the array, the type of elements in the array, the configuration of the elements, the signal amplitude applied to each element, and the excitation phase of each element. Design of an array antenna generally starts with a determination of the particular antenna pattern that is required by the underlying system. Once the pattern is known, the array is designed by appropriately choosing the above factors. Methods for performing such a design are well known in the art.

A problem arises in an array antenna when an element failure occurs. That is, when one or more of the antenna elements (or associated transmit/receive circuitry) become inoperative during system operation, the resulting antenna pattern will change due to changes in the above listed factors. For example, the modified antenna pattern may display decreased directivity/gain, increased sidelobe levels, or reduced range. Thus, the underlying antenna may no longer be capable of performing the function(s) it was designed to perform.

In the past, one method used to overcome a potential decrease in antenna performance due to element failure was to use an increased number of antenna elements in the antenna to achieve performance characteristics that exceed those necessary for the underlying system. Thus, as elements begin to fail, the antenna performance slowly degrades toward the level of performance required by the underlying system. This technique works well, but it consumes a greater amount of power than is necessary to perform the underlying antenna application. As can be appreciated, this inefficiency is generally undesirable, especially in applications where power is scarce, such as satellite communications.

Therefore, there is a need for a method and apparatus for efficiently maintaining a desired level of antenna performance in an array antenna should element failures occur.

DETAILED DESCRIPTION OF A PREFERRED EMBODIMENT

The present invention relates to a method and apparatus for efficiently maintaining a desired level of antenna performance during the life of an array antenna even though element failures may occur in the array. The method and apparatus can significantly reduce overall power consumption during the life of the array antenna and is thus of great benefit in systems where power is a scarce resource. An array antenna is provided that has a greater number of antenna elements than are needed to provide a level of antenna performance required by an underlying application. During antenna operation, some of the elements in the array are kept inactive so that only enough elements are active at any particular time to ensure the desired level of antenna performance. If an active element subsequently fails, one of the inactive elements is activated to replace the failed element. Preferably, the replacement element is chosen as the nearest inactive element to the failed element to have minimal impact on antenna pattern. Because only a minimal number of elements are active in the array, power consumption is significantly reduced. The inventive principles allow an array antenna to operate in a substantially uninterrupted fashion, and at or above a minimal level of performance, for its entire anticipated lifetime with no need for costly and time consuming element reinstallations to replace failed elements. The inventive principles are applicable to any array antenna system and are particularly beneficial in phased array systems.

Figure 1:
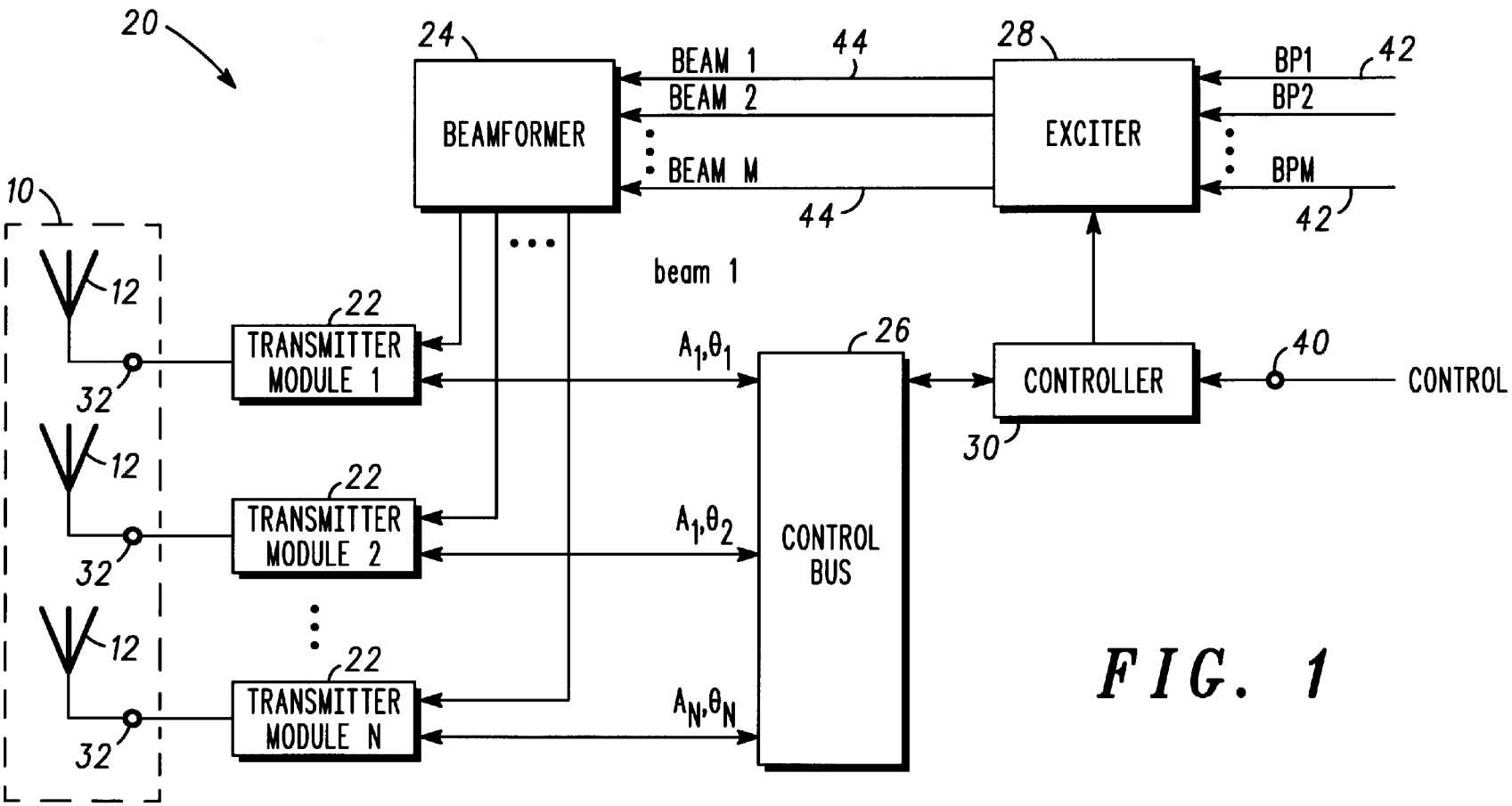
FIG. 1 is a block diagram illustrating a phased array antenna system that can utilize the principles of the present invention.

FIG. 1 is a block diagram illustrating a phased array antenna system 20 that can utilize the principles of the present invention. As illustrated, the phased array antenna system 20 includes: an array of antenna elements 10, a plurality of transmitter modules 22, a beamformer network 24, a control bus 26, an exciter 28, and a controller 30. For purposes of convenience, the system 20 will be described as a transmit-only system (i.e., including only a plurality of transmitter modules 22). However, it should be appreciated that the system 20 could include transmit/receive (T/R) modules or receiver modules in place of the plurality of transmitter modules 22 without departing from the spirit and scope of the present invention. The phased array antenna system 20 will generally be part of a larger system, such as a radar or communications system. In one embodiment, for example, the phased array antenna system 20 is part of a satellite downlink transmitter in a satellite communications system.

During normal system operation, the array of antenna elements 10 is operative for transmitting radio frequency (RF) signals to one or more remote locations. For example, in a satellite downlink application, the array of antenna elements 10 would transmit communications signals from a communications satellite carrying the array 10 to one or more terrestrial communications base stations. In the illustrated embodiment, the phased array antenna system 20 is capable of generating multiple simultaneous beams in a plurality of different directions. For example, one beam can be used by the system 20 to communicate with each of a plurality of remote communications entities (e.g., a plurality of terrestrial base stations). In addition, as will be described in greater detail, each of the beams may be independently steerable. It should be appreciated, however, that the inventive principles are not limited to use with multi-beam or steerable beam systems. That is, single, fixed beam systems can also benefit from use of the inventive principles.

Figure 2:
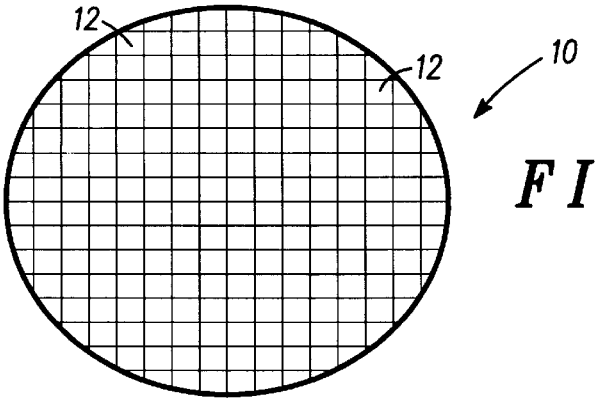
FIGS. 2–6 are front views of an antenna array illustrating various states of antenna operation in accordance with one embodiment of the invention.

FIG. 2 is a simplified front view of an array antenna 10 that can utilize the principles of the present invention. As shown, the array antenna 10 includes a plurality of antenna elements 12 arranged in rows and columns in a circular configuration. Many other array configurations are possible. The antenna elements 12 can include any of a number of different element types. The type of elements chosen for a particular application will depend upon various factors including desired antenna pattern, cost, and antenna power efficiency. It should be understood that the principles of the present invention can be advantageously implemented in arrays using virtually any array configuration or element type(s) and the structure illustrated in FIG. 1 is not meant to be limiting.

To achieve a desired transmit antenna pattern, the elements 12 of the antenna array 10 are fed input signals by the transmitter modules 22 having predetermined parameter value relationships. For example, a predetermined excitation phase increment may be used between adjacent elements 12 in the array 10 to achieve a desired direction in a resulting beam. Similarly, amplitude tapering techniques between elements may be used to reduce or control sidelobe generation by the antenna array 10. In multiple beam systems, different excitation phase increments and/or amplitude tapers may be used for different beams.

Referring back to FIG. 1, the controller 30 is operative for controlling the individual components of the phased array antenna system 20. In the illustrated embodiment, the controller 30 is under the control of a separate system controller (not shown) that delivers commands and instructions to the controller 30 via control input 40. Alternatively, the controller 30 can be an autonomous unit that is not under external control. In a preferred embodiment, the controller 30 comprises a digital processing unit that is capable of executing software routines stored within a memory therein. The digital processing unit can include, for example, a general purpose microprocessor, a digital signal processor (DSP), a reduced instruction set computer (RISC), or a complex instruction set computer (CISC). Alternatively, reconfigurable hardware, such as a field programmable gate array (FPGA), can be used.

The exciter 28 is primarily a power amplification unit that is operative for increasing the strength of transmit signals before the signals are delivered to the beamformer 24. The exciter 28 includes a plurality of beam ports 42 for receiving transmit signals corresponding to each of the individual transmit beams of the system 20 from, for example, communications functionality coupled to the system 20. The exciter 28 amplifies each of the transmit signals by an appropriate amount and delivers the amplified signal to the beamformer 24 via a corresponding beam line 44. The exciter 28 can be a single integrated unit or a plurality of separate units can be used.

In one approach, the transmit signals delivered to the exciter 28 via the beam ports 42 have each already undergone frequency up-conversion before entering the exciter 28. Alternatively, the exciter 28 can include internal frequency conversion functionality for performing the necessary frequency conversions for each of the beams. The controller 30 preferably maintains control over the operation of the exciter 28 and, in one embodiment, is capable of independently controlling a level of power gain used for each of the transmit beams. The controller 30 may also be capable of disabling one or more of the antenna beams by, for example, deactivating corresponding amplification functionality within the exciter 28.

The beamformer network 24 is operative for creating the drive signals that are delivered to the transmitter modules 22 for each of the individual transmit beams. That is, for each beam, the beamformer network 24 receives a transmit signal on a corresponding beam line 44 and divides the transmit signal into a plurality of drive signals having the amplitude and phase characteristics that are necessary to generate a desired nominal antenna pattern. Thus, at a minimum, the beamformer network 24 includes a series of power divider and phase shifter units for splitting each of the input beam signals into a plurality of separate drive signals having predetermined phase/amplitude relationships. In addition, the beamformer network 24 can include amplification functionality for increasing the amplitude of each of the beam signals before, during, and/or after the signals have been divided. As with the exciter 28, the beamformer 24 can include either a single integrated unit or a plurality of separate units. Alternatively, a digital beamformer network can be used.

The transmitter modules 22 represent, among other things, a final amplification stage for the transmit signals before they are delivered to the feed ports 32 of the antenna elements 12. In addition, the transmitter modules 22 can be used to perform signal compensation and/or beam steering functions. As illustrated in FIG. 1, the transmitter modules 22 receive control signals from the controller 30 via control bus 26. In the illustrated embodiment, the controller 30 delivers amplitude and phase correction information $A_i$, $2_i$ to the individual modules 22 for use in processing the nominal drive signals received from the beamformer 24 to compensate for such things as ambient temperature variations about the system 20. In addition, the controller 30 can also delivers excitation phase information to the modules 22 for use in steering the associated beams from their nominal beam positions. That is, in an embodiment where the individual beams share the antenna array 10 using a time-based multiplexing approach, beam steering excitation phase values can be delivered to the transmitter modules 22 for each of the beams. The individual transmitter modules 22 can then use the excitation phase information to configure one or more internal phase shifter structures during each corresponding beam time interval. In an embodiment where multiple independent beams are simultaneously generated by the antenna array 10, beam steering phase shifters for independent steering of the beams are implemented in the beamformer 24, not the modules 22. In addition, the controller 30 can activate and deactivate each of the transmitter modules 22 by delivering an appropriate command to the module 22 via the control bus 26.

In a preferred approach, an addressing scheme is used to direct control signals to the appropriate transmitter modules 22 using control bus 26. Alternatively, a multiple access scheme such as frequency division multiple access (FDMA), time division multiple access (TDMA), or code division multiple access (CDMA) can be used to distribute control signals on the bus 26. As will be apparent to persons of ordinary skill in the art, a number of alternative methods for delivering control signals to the transmitter modules 22 exist in addition to the control bus approach including, for example, hard wiring the controller 30 to each individual module.

In conceiving of the present invention, it was determined that significant power savings could be achieved by activating only selected elements within the array 10 during normal antenna operation. The number of active elements is determined based on a minimum level of antenna performance required by the underlying antenna application. Thus, less than all of the elements 12 in the array 10 are activated at any particular time. As active elements fail in the array 10, previously inactive elements are activated to replace the failed elements. The method for selecting a replacement element from a present group of inactive elements will preferably have minimal impact on the overall antenna pattern. The number of spare elements used in the array 10 is preferably selected based upon the predicted element failure rate for the array 10. In one approach, for example, the number of spare elements is based on the number of element failures that are anticipated within the designed lifetime of the array 10.

Figure 3:
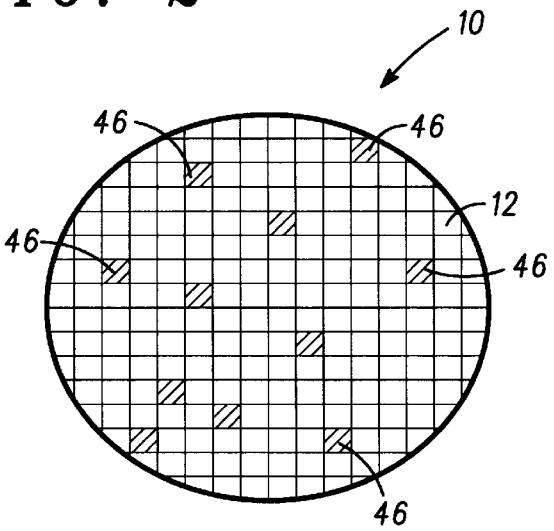

FIG. 3 is a front view of the array antenna 10 of FIG. 2 indicating (using shading) the locations of a plurality of inactive antenna elements 46 in accordance with one embodiment of the present invention. Preferably, the inactive elements 46 are randomly distributed within the array 10 to reduce the creation of undesired sidelobes by the antenna system 20. In a preferred embodiment, the controller 30 (see FIG. 1) is operative for determining which elements are to remain inactive and for deactivating the corresponding transmitter modules 22 by delivering appropriate control signals to the modules 22 via control bus 26. The controller 30 can also periodically change the group of elements that are inactive to even out element usage within the system. This technique is particularly useful in systems where the failure rate of active elements (and their associated electronics) is significantly greater than the failure rate of inactive elements.

During operation, the controller 30 monitors the active elements 12 in the array 10 to determine whether they are operating properly. In the illustrated embodiment, for example, this can be done by sending a query to each of the transmitter modules 22 via control bus 26 requesting status information. The modules 22 can then each return a status message to the controller 30 via control bus 26. If the controller 30 does not receive a status message from a particular module 22, or if a negative status message is received from a module 22, the controller 30 will determine that a replacement needs to be made. In one embodiment of the invention, each module 22 includes diagnostic software for performing a series of tests within the transmitter module 22, and on the corresponding element 12, to determine present operating status. The test results are then used by the module 22 to create the status message that will be delivered to the controller 30. As will be apparent to persons of ordinary skill in the art, a number of alternative methods for determining the present operational status of the active modules 22 and elements 12 also exist.

Figure 4:
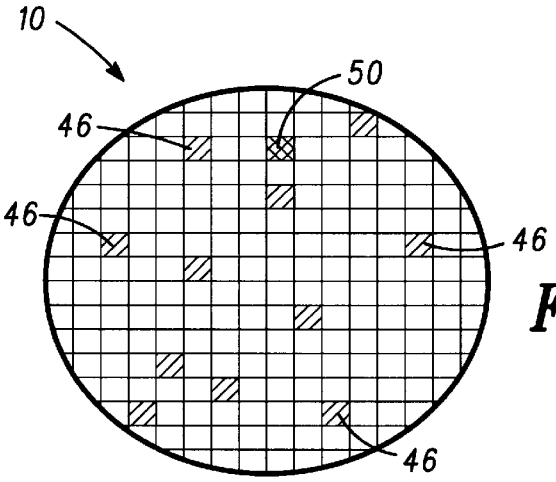

FIG. 4 is a front view of the array antenna 10 of FIG. 3 indicating (by blacked out element 50) that a failure of one of the active elements in the array 10 has occurred. The controller 30 detects the failed element 50 and determines that a replacement is to be made. The controller 30 then selects one of the previously inactive elements 46 and activates the element by delivering an activation command to the element. The controller 30 may also send a deactivation command to the failed element so that the failed element will no longer consume power.

Figure 5:
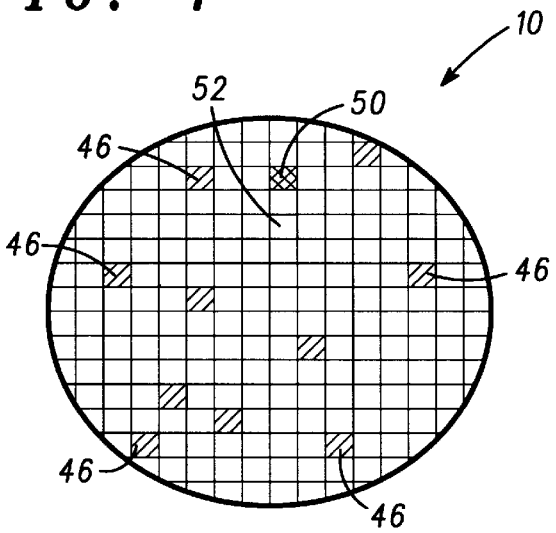

The controller 30 can select the replacement element in any of a number of different ways. In the simplest approach, a replacement element is randomly selected from among the inactive elements 46. While easy to perform, this technique can result in a significant reduction in sidelobe performance if the replacement element is poorly chosen. In a more complex approach, the controller 30 chooses the inactive element 46 that is physically closest to the failed element 50 as the replacement. For example, FIG. 5 is a front view of the array antenna 10 of FIG. 4 indicating that a previously inactive element 52 that is nearest to the failed element 50 has been activated as a replacement therefor. By using a nearest inactive element as a replacement, the original randomness of the inactive element distribution is maintained as closely as possible.

The inter-element distance determination can be carried out in a number of different ways. For example, in one approach, positional coordinates are assigned to each of the antenna elements 12 in the array 10 describing a relative location of a center of each element 12. The controller 30 uses the coordinates to calculate inter-element distance using a simple formula. In another technique, a lookup table is used to store and retrieve the inter-element distances of each element pair in the array 10. The controller 30 then simply retrieves the inter-element distances between the failed element and each of the inactive elements and selects the inactive element with the lowest distance as the replacement element. Other techniques for determining inter-element distances are also possible.

Figure 6:
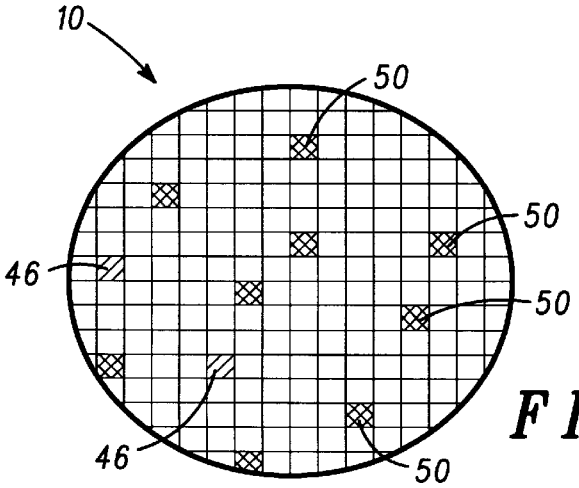

In one embodiment of the invention, the controller 30 includes functionality for redistributing the inactive elements in the array 10 after a predetermined event has occurred, to enhance antenna performance. That is, new inactive element locations are determined by the controller 30 in light of the known locations of failed elements within the array 10. In one approach, the redistribution process is primarily concerned with maintaining an optimal amount of randomness in the locations of the inactive elements to enhance antenna sidelobe performance. FIG. 6 is a front view of the array antenna 10 of FIG. 5 indicating that nine element failures have occurred in the array 10. As shown, the two remaining inactive elements 46 have been relocated from their previous positions (see FIG. 5) so that the overall pattern of inactive and failed elements is as random as possible.

In one technique, redistributions of inactive element locations are performed periodically or after a predetermined period of antenna operation, regardless of a present number of failed elements. In another technique, a redistribution is initiated only after a predetermined number of element failures have occurred. In such an approach, the controller 30 can initiate the redistribution immediately after the $N^{th}$ element failure has been detected or it can wait for a period of low antenna activity after the $N^{th}$ element failure to perform the redistribution. Because the redistribution may cause a temporary disruption of antenna operation, it may be desirable to limit such activities to periods of low antenna traffic.

A redistribution of inactive element locations can also be initiated in response to a command received from an exterior source. For example, in a satellite based application, measurements made on the ground might indicate that sidelobe levels for a particular satellite transmit beam are higher than an acceptable value. A command can then be sent to the satellite instructing it to redistribute the inactive element locations in the downlink array to reduce the sidelobe levels. The controller 30 can then determine the new inactive element locations based on the known locations of the failed elements 50.

In one aspect of the present invention, software is provided for determining optimal inactive element locations within the array 10 for any particular combination of failed elements. That is, a program is provided that can determine to some degree of accuracy which combination of inactive elements will produce the best sidelobe performance given the locations of the failed elements 50. The program can also determine such things as optimal drive amplitudes for the active elements in the array to enhance performance in light of the failed element locations and the selected inactive element locations. Such an analysis can be performed numerically using, for example, a genetic algorithm approach. (See, e.g., "Array Correction with a Genetic Algorithm" by Yeo et al. in the May, 1999 issue of the *IEEE Transactions on Antennas and Propagation,* vol. 47, no. 5, pgs. 823–828.) In addition to use during element redistribution, the above-described program could also be used to determine the initial set of inactive element locations in the array 10 and appropriate amplitudes for the initial active elements to maximize performance. Such a program, however, is not necessary to the proper functioning of the invention.

In the preceding discussion of a preferred embodiment of the invention, the controller 30 of FIG. 1 was responsible for carrying out many of the inventive functions. It should be appreciated, however, that the inventive principles are not limited to implementation with a single resident controller or processor unit. For example, a multiple processor implementation can be used wherein different functions are performed within different processor units. Alternatively, one or more remote processing units can be used to control the various structures within the antenna system 20 from a remote location via, for example, a wireless communication link. Furthermore, manual performance of many of the inventive concepts can be carried out in accordance with the present invention. For example, a manual determination of element failure can be performed by observing the state (i.e., on or off) of a light emitting diode (LED) on the body of a transmitter module 22. If an element failure is indicated, the effected module can be manually deactivated and a replacement module can be manually activated.

Figure 7:
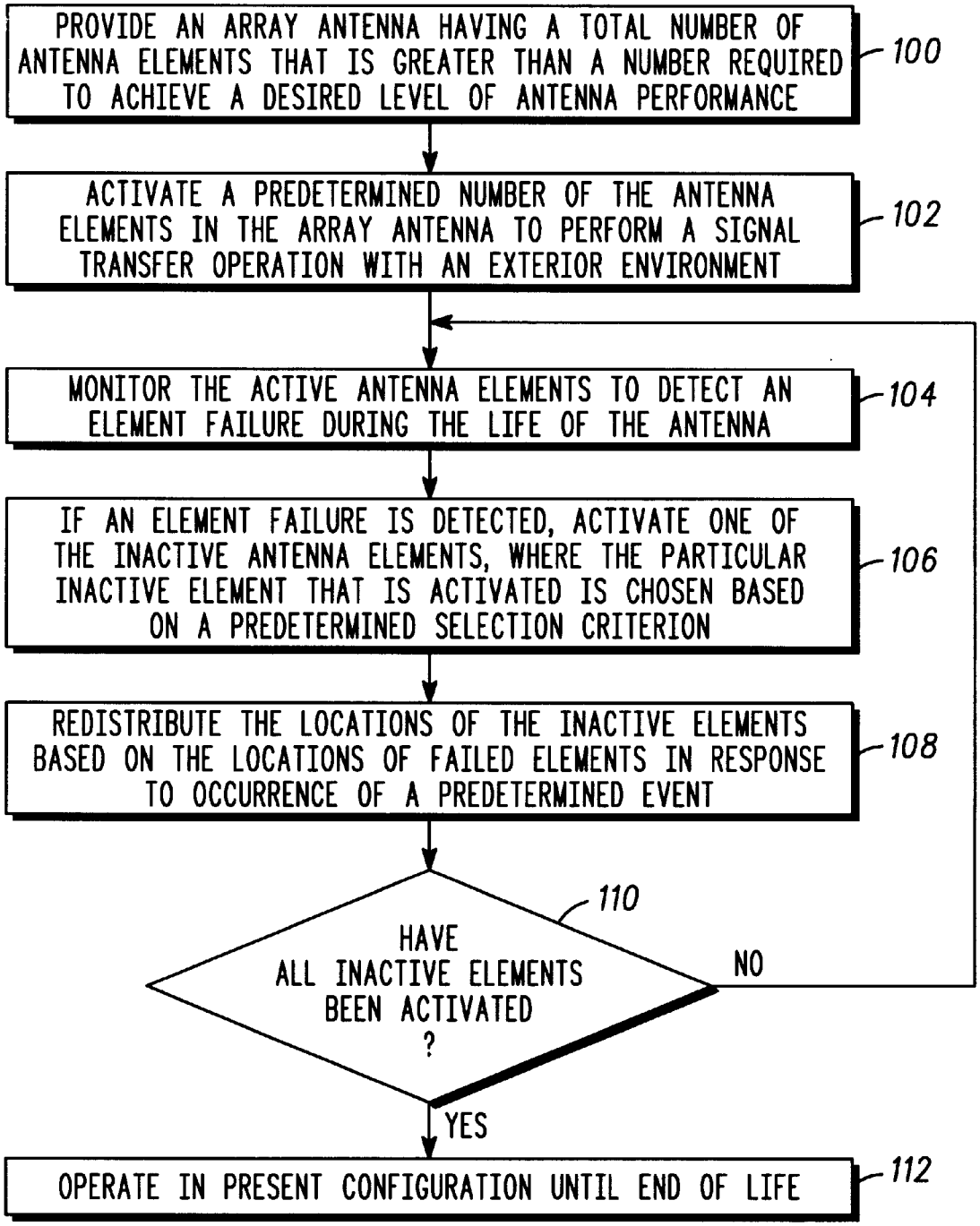
FIG. 7 is a flowchart illustrating a method for operating an array antenna in accordance with one embodiment of the present invention.

FIG. 7 is a flowchart illustrating a method for operating an array antenna in accordance with one embodiment of the present invention. First, an array antenna is provided that has a greater number of antenna elements than is needed to achieve a desired level of antenna performance (step 100). The array antenna is operated with only some of the antenna elements active (step 102). The inactive elements are preferably randomly distributed throughout the array. The is active array elements are then monitored to determine whether any element failures have occurred in the array (step 104). If an element failure is detected, one of the previously inactive elements is activated to serve as a replacement for the failed element (step 106). A predetermined selection criterion is used to select the replacement element. In response to the occurrence of a predetermined event, the inactive elements within the array will be redistributed based on the locations of failed elements within the array (step 108). The predetermined event can include, for example, the occurrence of a predetermined number of element failures and/or the receipt of a redistribution command from an exterior source. After all of the available inactive elements have been activated, the antenna array operates in its then current configuration for the remainder of its life (steps 110 and 112).

Although the present invention has been described in conjunction with its preferred embodiments, it is to be understood that modifications and variations may be resorted to without departing from the spirit and scope of the invention as those skilled in the art readily understand. Such modifications and variations are considered to be within the purview and scope of the invention and the appended claims.

What is claimed is:

1. A method for managing operation of an array antenna system, comprising the steps of:

providing an array antenna having a plurality of antenna elements arranged in fixed relation to one another;

activating a predetermined number of said plurality of antenna elements to form an antenna beam for use in communicating with an exterior environment, said predetermined number being less than a total number of elements in said plurality of antenna elements;

monitoring active antenna elements in said plurality of antenna elements to detect whether an element failure has occurred; and when an element failure is detected, activating a previously inactive antenna element in said plurality of antenna elements to replace a failed element.

2. The method claimed in claim 1, wherein:

said step of activating a previously inactive antenna element includes selecting one of a plurality of previously inactive antenna elements based on a predetermined criterion.

3. The method claimed in claim 2, wherein:

said predetermined criterion includes selecting a previously inactive antenna element that is nearest to said failed element.

4. The method claimed in claim 2, wherein:

said predetermined criterion includes randomly selecting a previously inactive antenna element from said plurality of previously inactive antenna elements.

5. The method claimed in claim 1, further comprising the step of:

repeating said steps of monitoring and activating until each of said plurality of antenna elements has either been activated or has failed.

6. The method claimed in claim 1, further comprising the step of:

changing locations of inactive elements within said array antenna in response to occurrence of a predetermined event, wherein said step of changing includes activating a number of previously inactive elements and deactivating an equal number of previously active antenna elements.

7. The method claimed in claim 6, wherein:

said step of changing includes redistributing inactive elements based upon known locations of failed elements, to enhance sidelobe performance.

8. The method claimed in claim 6, wherein:

said predetermined event includes detection of a predetermined number of element failures.

9. An array antenna system comprising:

a plurality of antenna elements arranged in fixed relation to one another;

a controller for activating a predetermined number of antenna elements within said plurality of antenna elements to generate an antenna beam for use in performing signal transfer functions with an exterior environment, said predetermined number being less than a total number of elements in said plurality of antenna elements;

a monitor for monitoring active antenna elements within said plurality of antenna elements to determine when an element failure has occurred; and means for activating a previously inactive antenna element within said plurality of antenna elements for use in generating said antenna beam in response to detection of an element failure by said monitor.

10. The system claimed in claim 9, wherein:

said controller includes means for randomly selecting antenna elements within said plurality of antenna elements that will remain inactive during performance of said signal transfer functions.

11. The system claimed in claim 9, further comprising:

a redistribution unit for redistributing inactive element locations within said plurality of antenna elements in response to occurrence of a predetermined event.

12. The system claimed in claim 9, wherein:

said means for activating includes means for selecting a previously inactive antenna element that is closest to a failed element for activation.

13. The system claimed in claim 9, wherein:

said means for activating includes means for activating an electronic module associated with said previously inactive antenna element.

14. The system claimed in claim 13, wherein:

said electronic module includes one of the following: a transmit module, a receive module, and a transmit/receive (T/R) module.

15. An array antenna system comprising:

a plurality of antenna elements having a total number of elements that is greater than a number required to achieve a desired level of antenna performance;

a plurality of solid state modules, each of said plurality of solid state modules being coupled to at least one of said plurality of antenna elements; and a controller for controlling operation of said array antenna system, said controller including means for individually activating and deactivating each of said plurality of solid state modules, said controller maintaining only a subset of said plurality of solid state modules in an active condition during operation of said array antenna system, said subset of said plurality of solid state modules including a predetermined quantity of solid state modules that is less than a total quantity of solid state modules in the plurality of solid state modules, said controller including means for automatically activating an inactive solid state module in said plurality of solid state modules when an active solid state module indicates that a failure has occurred.

16. The system claimed in claim 15, wherein:

said controller includes at least one digital processing unit.

17. The system claimed in claim 15, wherein:

said predetermined quantity remains constant during a life of said array antenna system.

18. The system claimed in claim 15, wherein:

said plurality of solid state modules includes at least one of the following: a transmit module, a receive module, a transmit/receive (T/R) module.

19. The system claimed in claim 15, wherein:

said means for automatically activating includes means for selecting an inactive solid state module from said plurality of solid state modules based on a predetermined selection criterion.

20. The system claimed in claim 19, wherein:

said predetermined selection criterion includes selection of an inactive solid state module that is coupled to an antenna element that is closest to an antenna element coupled to the active solid state module indicating a failure.

* * * * *